United States Patent [19]

Dury

[11] Patent Number: 4,501,420

[45] Date of Patent: Feb. 26, 1985

[54] PLAYING SURFACES SPORTS

[75] Inventor: Peter L. K. Dury, West Bridgford, England

[73] Assignee: Nottingham County Council, England

[21] Appl. No.: 488,626

[22] Filed: Apr. 25, 1983

[30] Foreign Application Priority Data

Apr. 27, 1982 [GB] United Kingdom ..... 8212124

[51] Int. Cl.[3] ..... A63C 19/00

[52] U.S. Cl. ..... 272/3; 273/DIG. 13; 404/35; 428/17

[58] Field of Search ..... 272/3, 109, 144, 100, 272/101; 273/25, 27, 29 R, 55 R, 195 R, DIG. 13; 404/31, 35, 44, 66, 67, 82; 428/17

[56] References Cited

U.S. PATENT DOCUMENTS

| | | | |
|---|---|---|---|
| 1,763,782 | 6/1930 | Henderson | 272/3 X |
| 3,242,509 | 3/1966 | Nissen | 272/109 X |
| 3,636,577 | 1/1972 | Nissen | 272/109 X |
| 3,682,476 | 8/1972 | Kempson et al. | 272/3 |
| 3,863,387 | 2/1975 | Webster et al. | 272/3 UX |
| 4,168,061 | 9/1979 | Gordon | 272/101 |
| 4,281,791 | 8/1981 | Schaaf et al. | 404/35 X |

FOREIGN PATENT DOCUMENTS

| | | | |
|---|---|---|---|
| 2911690 | 10/1980 | Fed. Rep. of Germany | 272/3 |
| 2397205 | 3/1979 | France | 272/101 |

*Primary Examiner*—Robert A. Hafer
*Assistant Examiner*—Arnold W. Kramer
*Attorney, Agent, or Firm*—Poms, Smith, Lande & Rose

[57] ABSTRACT

A method of constructing a playing surface for sports such as soccer, cricket and tennis is disclosed, comprising the steps of laying one or more flexible water-permeable envelopes containing an unbonded base material comprising sand on a drained or water-permeable surface, and placing a sheet of resilient material on to the envelope. In a preferred embodiment, a second sheet of resilient material having different bounce characteristics from the first is placed on the first sheet, and an artificial turf material is laid on top.

14 Claims, 3 Drawing Figures

PLAYING SURFACES SPORTS

BACKGROUND OF THE INVENTION

This invention relates to a method of constructing a playing surface for sports and the like.

Because of the problems of maintaining in good condition traditional grass or turf playing surfaces for such sports as soccer, cricket and tennis, especially when the surfaces are subject to frequent use during periods of excessively high or low rainfall, synthetic turfs, typically in the form of a resilient carpet formed from plastics materials such as polypropylene, have been developed. Synthetic turfs have heretofore been laid in the manner of a carpet, using a resilient underlay placed on a prepared surface such as concrete with suitable drainage. A problem experienced with such playing surfaces is that the playing characteristics of the surfaces are very different from conventional turf, the ball in ball games bouncing faster and rolling differently.

BRIEF SUMMARY OF THE INVENTION

According to the present invention there is provided a method of constructing a playing surface for sports and the like, characterised by the steps of:

(A) laying on a drained or water-permeable surface at least one envelope formed of a flexible water-permeable material and containing an unbonded base material comprising sand; and (B) placing on the envelope or envelopes a sheet of a resilient material.

The sheet of resilient material may be formed from rubber particles, such as comminuted used motor vehicle tyres, bonded together with a polymeric material. The thickness of the sheet will depend on the game for which the surface is intended and the construction of the underlying envelopes and surface. A typical thickness would be 6 mm.

Alternatively, the sheet of resilient material may comprise dense expanded polyethylene. A combination of the two types of resilient sheet material may be used, with either the bonded particulate rubber material or the polyethylene material lowermost according to the characteristics of the surface required. A synthetic playing surface material, such as a synthetic turf or a carpet material, may be placed on the resilient sheet or sheets, to simulate more closely a turf playing surface. In one embodiment of the invention a synthetic playing surface material itself constitutes the resilients sheet material laid direct on the envelope or envelopes.

Preferably, the thickness of the base material in the envelope or envelopes is in the range of 12 mm to 75 mm. The thickness chosen will depend upon the characteristics desired. Preferably, especially for surfaces other than for cricket a plurality of envelopes is used, the envelopes fitting together to form a continuous layer, the sheet of resilient material being placed on the continuous layer so formed. The sizes of the envelopes preferably vary from 4 m wide×20 m long in areas of less intense wear to 2 m wide×7 m long in areas of high intensity wear. The or each envelope may by subdivided by the use of resiliently-compressible strips, e.g. of expanded plastics material, laid on to the lower layer of envelope material.

Suitable ranges of compositions for the base material are indicated in the following table

TABLE

| | BASE MATERIAL COMPOSITIONS | | | | | | | | | |
|---|---|---|---|---|---|---|---|---|---|---|
| | Coarse Gravel 10 mm to 5 mm | Fine Gravel 5 mm to 2 mm | Very Coarse Sand 2 mm to 1 mm | Coarse Sand 1.0 mm to 0.25 mm | Medium Sand 0.5 mm to 0.25mm | Fine Sand 0.250 mm to 0.125 mm | Very Fine Sand 0.125 mm to 0.050 mm | Coarse Silt 0.050 mm to 0.020 mm | Fine Silt 0.020 mm to 0.002 mm | Clay 0.002 mm to less |
| 1 Winter Games Pitches | 7 to 1 | 17 to 2 | 10 to 4 | 14 to 12 | 40 to 54 | 12 to 24 | 3 | | | |
| 2 Cricket Tennis Kick-about areas | — — | 42 to 28 | 7 to 8 | 19 to 15 | 13 to 26 | 5 to 9 | 2 to 2 | 2 to 2 | 5 to 2 | 5 to 8 |

The characteristics of the base material may alternatively be modified by adding to the sand materials such as plastics foam chips or particles. These envelopes may be formed of pairs of sheets of permeable fabric, pinned or glued or otherwise joined together at the edges. Different types of fabric may be used to form the upper and lower layers of the envelope.

The method of the invention produces a playing surface which avoids the maintenance requirements of conventional turf but which gives playing characteristics much closer to those achieved by conventional turf and which change with weather conditions in a similar manner to conventional turfs, but without the risk of degradation of the surface into mud, or ruts in very dry or very cold weather.

BRIEF DESCRIPTION OF THE DRAWINGS

Further features, details, and advantages of the invention will be apparent from the following description of alternative embodiments of the invention, with reference to the drawings, in which.

DETAILED DESCRIPTION

Figure 1:
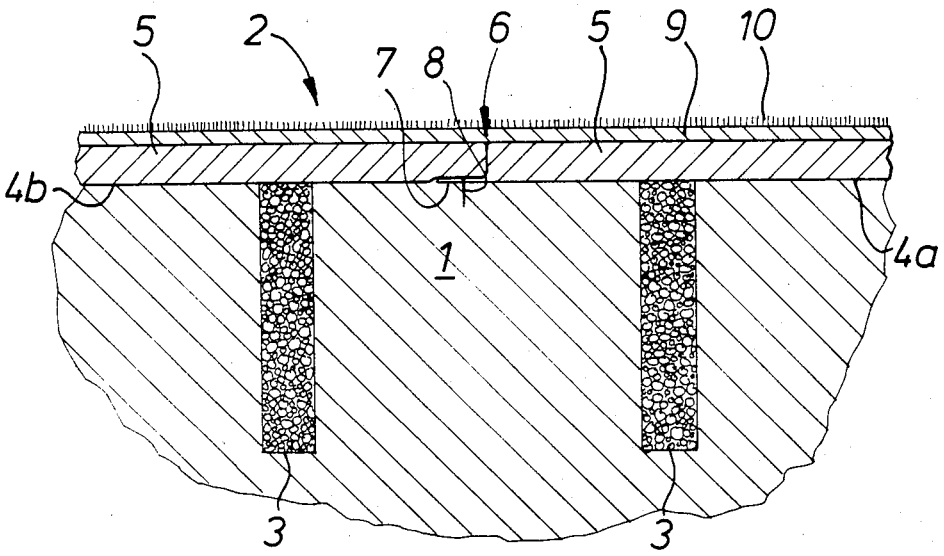
FIG. 1 is a sectional view of a playing surface suitable for winter games.

Referring first to FIG. 1, the ground 1 upon which the playing surface 2 is to be laid is first prepared, if not already adequately drained, by the installation of drainage channels or 3 filled with suitable permeable material and then levelled.

Envelopes 4 are prepared from sheets of a permeable glass fibre fabric, filled with the sand base material 5, and folded and pinned at the edges. At joins 6 between adjacent envelopes, the edge 7 of the first envelope 4*a* is left free of sand and is pinned or nailed to the ground using corrosion-resistant nails 8 of suitable length. The second envelope 4*b* is then positioned over the thin edge portion 7. The composition of the sand base materials is chosen from the range of compositions set out hereinbefore in the Table, for winter games pitches. An underlay 9, comprising a mat of polymer bonded rubber particles, is then laid on top of the envelopes and suitably secured, e.g. by nails or pins at the edges thereof, and the synthetic turf 10 can then be laid on the underlay 9 in the conventional manner.

Figure 2:
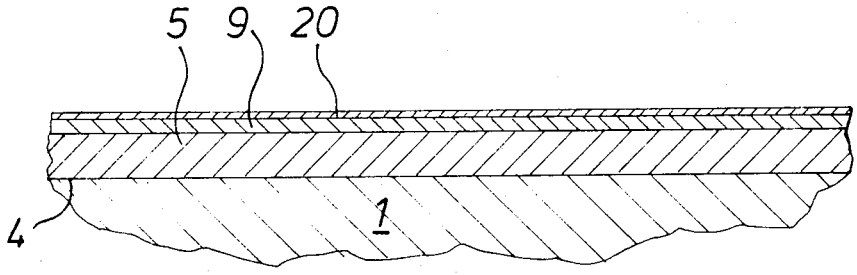
FIGS. 2 and 3 are sectional views of playing surfaces similar to that shown in FIG. 1, but modified to produce characteristics suitable for cricket or tennis.
Figure 3:
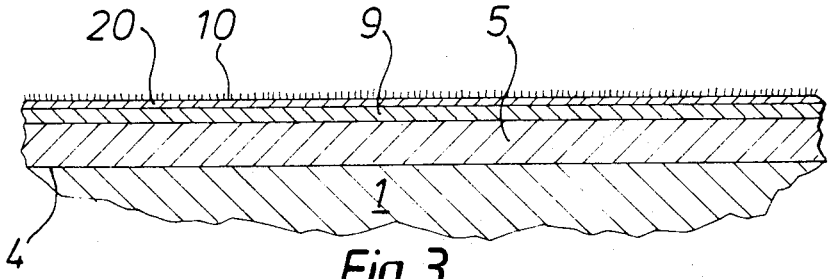

The surfaces illustrated in FIGS. 2 and 3 are modified to suit summer games such as cricket or tennis. The sand base material 5 is chosen from a range of compositions in the second part of the Table hereinbefore. In the surface illustrated in FIG. 2, the synthetic turf is replaced by a layer 20 of a dense polyethylene foam with a thickness of about 5 mm and a density of 175 kg/m$^3$. This layer 20 serves to reduce the degree of bounce of a ball striking the surface, and is in itself known for such applications. In FIG. 3, the surface illustrated is identical to that of FIG. 2, but has a layer of synthetic turf placed on the foam layer 20.

I claim:

1. A method of constructing a playing surface for sports and the like, characterised by the steps of:

(A) laying on a drained or water-permeable surface at least one envelope formed of a flexible water-permeable material and containing an unbonded base material comprising sand; and (B) placing on to said envelope or envelopes a sheet of a resilient material.

2. A method according to claim 1, wherein step (A) comprises laying a plurality of said envelopes so that the envelopes butt together to form a continuous layer.

3. A method according to claim 1, wherein said sheet of resilient material is formed from rubber particles bonded together.

4. A method according to claim 1, wherein said sheet of resilient material comprises dense expanded polyethylene.

5. A method according to claim 1, comprising placing a second sheet of resilient material on said sheet of resilient material, said second sheet having a different stiffness and/or resilience from the first.

6. A method according to claim 5, comprising laying on to said second sheet of resilient material a synthetic playing surface material.

7. A method according to claim 5, comprising laying on to said second sheet of resilient material a synthetic turf material.

8. A method according to claim 1, comprising laying on to said resilient material a synthetic playing surface.

9. A method according to claim 1, comprising laying on to said resilient material a synthetic turf material.

10. A method according to claim 1, wherein the thickness of said base material in the envelope or envelopes is from 12 mm to 75 mm.

11. A method according to claim 1, wherein the sizes of the envelopes are from 2 m wide and 7 m long to 4 m wide and 20 m long.

12. A method according to claim 1, wherein said base material also contains gravel.

13. A method according to claim 12, wherein said base material also contains clay.

14. A method according to claim 1, wherein said base material also contains clay.

* * * * *